United States Patent [19]

Buck

[11] Patent Number: 4,649,777

[45] Date of Patent: Mar. 17, 1987

[54] BACK-UP POWER TONGS

[76] Inventor: David Buck, 4225 Highway 90 East, Broussard, La. 70518

[21] Appl. No.: 770,852

[22] Filed: Aug. 29, 1985

Related U.S. Application Data

[63] Continuation-in-part of Ser. No. 623,040, Jun. 21, 1984, Pat. No. 4,576,067.

[51] Int. Cl.[4] ..... B25B 13/50; B25B 21/00

[52] U.S. Cl. ..... 81/57.19; 81/57.21; 81/57.34

[58] Field of Search ..... 81/57.16, 57.19, 57.21, 81/57.34

[56] References Cited

U.S. PATENT DOCUMENTS

| | | | |
|---|---|---|---|
| 3,796,418 | 3/1974 | Carlberg | 81/57.19 |
| 3,921,473 | 11/1975 | Boyadjiett et al. | 81/57.21 |
| 4,345,493 | 8/1982 | Rassieur | 81/57.34 |
| 4,402,239 | 9/1983 | Mooney | 81/57.21 |

*Primary Examiner*—Frederick R. Schmidt

*Assistant Examiner*—Debra S. Meislin

*Attorney, Agent, or Firm*—Robert C. Tucker; William David Kiesel; J. Bradley Overton

[57] ABSTRACT

Back-up power tongs are provided, for holding a tubular member, such as a drill pipe, against rotation of a connected tubular member, the back-up tongs comprising a body, having a center opening of sufficient size for the tubular member to pass therethrough, a slot communicating between the edge of the body and the center opening, and a cavity disposed within the body. A plurality of jaw members are disposed within the body around the perimeter of the center opening, each jaw member having a concave surface generally conforming to the curvature of the tubular member and facing the interior of the opening so as to be grippingly engageable with the tubular member. At least one cylinder assembly is disposed within the cavity and fixedly connected to one jaw member so as to extend or retract the jaw member on a radial path centered at the center of the tubular member.

11 Claims, 7 Drawing Figures

BACK-UP POWER TONGS

RELATED APPLICATIONS

This application is a continuation-in-part of U.S. patent application Ser. No. 623,040 filed June 21, 1984 by the inventor herein, now U.S. Pat. No. 4,576,067, and entitled, "Jaw Assembly", specific mention of which is made to obtain the benefit of its earlier filing date.

BACKGROUND OF INVENTION

1. Field of the Invention

This invention relates generally to devices which grip tubular members, such as drill pipe, and, more particularly, to devices which hold one segment of pipe immobile while another segment of pipe is connected or disconnected.

2. Prior Art

Pipe tongs are employed in the oil and gas industry to grip and rotate drill pipe. Some operate manually, while others are power assisted. It is necessary to grip drill pipe with extremely high compressive forces while applying a high degree of torque in order to break apart or tighten threaded pipe connections. In order to develop these forces, power tongs have been designed for gripping and rotating pipe. Back-up power tongs have been designed to hold one joint or segment of pipe while power tongs grip and rotate the adjacent joint of pipe. As can be seen, the gripping force of the back-up power tongs must be at least equal to that of the associated power tongs. Examples of power tongs and back-up tongs may be seen in the following U.S. Patents:

U.S. Pat. No. 4,290,304
U.S. Pat. No. 4,404,876
U.S. Pat. No. 4,082,017
U.S. Pat. No. 4,084,453
U.S. Pat. No. 4,089,240
U.S. Pat. No. 3,023,651

While back-up power tongs must develop a significant gripping force, rotary action is not required. The combination rotary/gripping action of power tongs has historically been produced by a cam assembly. Prior art back-up power tongs have also employed cam action to grip and hold pipe. As can be seen by referring to U.S. Pat. No. 4,290,304, cam action has also been employed to impart gripping forces in back-up power tongs. The assemblies comprising prior art back-up power tongs have heretofore been complicated and required a conversion of rotative forces to compressive forces, resulting in heavy, inefficient and expensive devices.

As can be seen in the above listed patents, the actual contact with the pipe is accomplished through the use of die inserts which are pressed into some type of jaw member. When the power tongs are in operation the die inserts are urged against the drill pipe and torque is applied. Examples of various configurations of die inserts may be found in FIG. 4 of U.S. Pat. No. 4,404,876 (see reference numerals 144,148 and 149), FIG. 5 of U.S. Pat. No. 4,082,017 (see reference numeral 34), and in FIGS. 4 and 5 of U.S. Pat. No. 4,290,304 (see reference numeral 92). As can be seen, the die inserts are relatively narrow in comparison to the jaw members to which they are attached, as well as to the total area of pipe covered by the jaw members. The die inserts are most commonly held in place through a dovetail key arrangement. Those die insert configurations illustrated above are virtually a standard in the industry.

Problems have developed with the above mentioned jaw/die configurations. The small wearing surfaces of prior art dies result in tremendous pressures (per unit of area) being applied to the drill pipe. These pressures result in deformation of the pipe, which in turn results in down time and pipe replacement costs. This is especially true in deep water drilling operations where lightweight pipe must be utilized. Also, as torque is applied, the dovetail keyway of prior art dies will wear due to the small surface area which must bear the torque, necessitating expensive replacement of the entire jaw/die assembly. Because of the small wearing surface of the dies, they are also prone to quickly wear out. The above problems were necessitated by the belief that the die size must remain small in comparison to the jaw member in order to provide the necessary bulk to resist the amount of torque which is applied to the pipe.

SUMMARY OF THE INVENTION

Therefore, it is an object of this invention to provide back-up power tongs which are inexpensive to construct, yet provide the necessary gripping force to hold a pipe against rotation.

It is another object of this invention to provide back-up power tongs in which dies may be easily changed in order to adapt the back-up power tongs to different pipe sizes.

It is still another object of this invention to provide back-up power tongs which are lightweight, have a minimum number of moving parts, and have easily replaceable parts.

It is a further object of this invention to provide back-up power tongs which require no conversion from rotative to compressive forces.

It is still a further object of this invention to provide back-up power tongs which grip a substantial circumferential portion of a tubular member.

Accordingly, back-up power tongs are provided, for holding a tubular member, such as a drill pipe, against rotation of a connected tubular member, the tongs comprising a body, having a center opening of sufficient size for the tubular member to pass therethrough, a slot communicating between the edge of the body and the center opening, and a cavity disposed within the body. A plurality of jaw members are disposed within the body around the perimeter of the center opening, each jaw member having a concave surface generally conforming to the curvature of the tubular member and facing the interior of the opening so as to be grippingly engageable with the tubular member. At least one cylinder assembly is disposed within the cavity and fixedly connected to one jaw member so as to extend or retract the jaw member on a radial path centered at the center of the tubular member.

DETAILED DESCRIPTION OF PREFERRED EMBODIMENTS OF THE INVENTION

Figure 1:
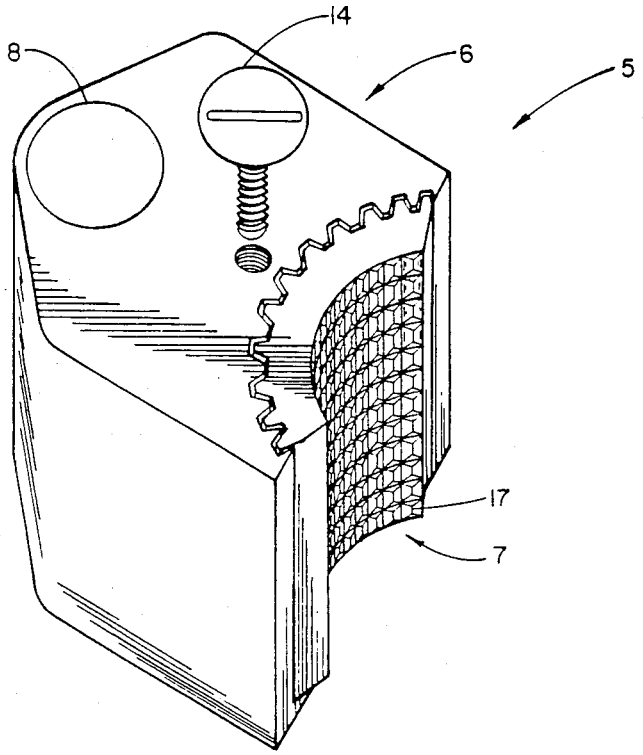
FIG. 1 is a perspective view of a preferred embodiment of the jaw assembly of this invention.

As shown in FIG. 1, the jaw assembly 5 comprises two major pieces—the jaw member 6 and the die 7. The jaw member 6 can be made to accommodate any of several different types of tongs or other pipe gripping devices currently on the market. For example, the jaw 6 shown in the figures is provided with a pin 8 which allows the jaw member 6 to pivot within a set of power tongs. The die 7 is slidably attachable to the jaw member 6. The configuration of the jaw assembly 5 allows for a much larger area of contact when the die 7 is urged against a tubular member 9, such as a drill pipe, eliminating pipe deformation caused by jaw member/-die combinations currently in use.

Figure 2:
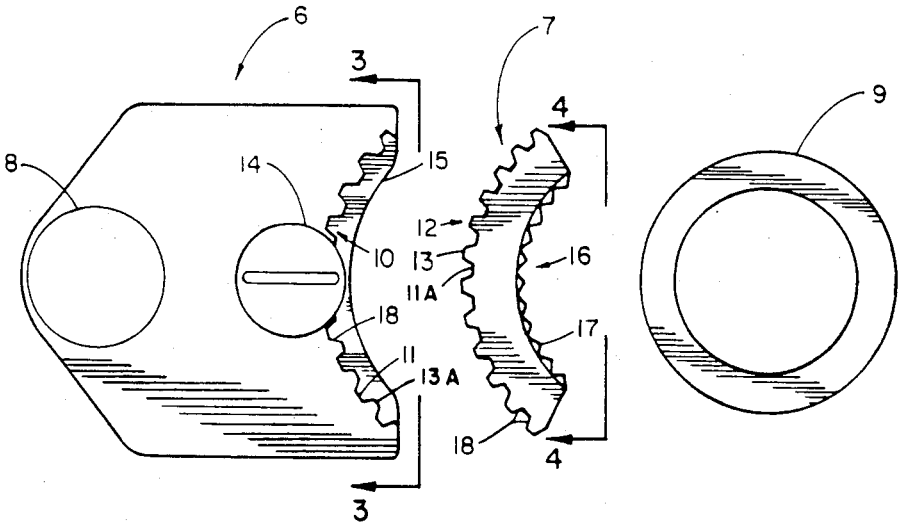
FIG. 2 is an exploded top view of a preferred embodiment of the jaw assembly of this invention.
Figure 3:
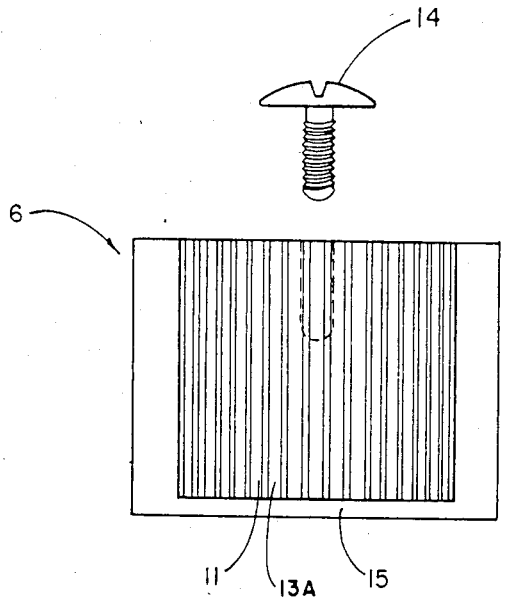
FIG. 3 is a front view of a preferred embodiment of the jaw member of this invention taken along line 3—3 of FIG. 2.
Figure 4:
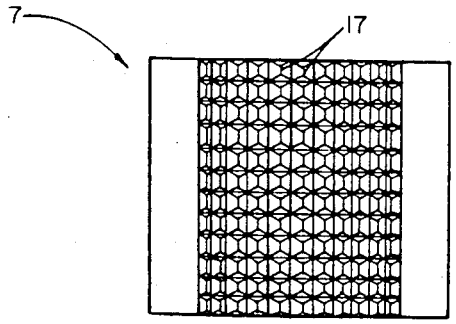
FIG. 4 is a front view of the die of this invention taken along line 4—4 of FIG. 2.

As shown in FIGS. 2 and 3, the jaw member 6 is provided with a concave surface 10, having grooves 11 milled therein. Correspondingly, the die 7 is provided with a convex surface 12, having splines 13 milled therein. The splines 13 are milled to matingly slide into the grooves 11 so as to hold the die 7 in place. The curvature of surfaces 10 and 12 coupled with the locking effect of splines 13 serve to firmly hold die 7 in position against rotative forces. The spline arrangement provides the necessary torque resistance to prevent excessive wear of splines 13. The die 7 is held vertically in place by conventional means such as screw 14 and lip 15.

The spline arrangement allows for a greatly increased distribution of force over the bearing surface wherein the die 7 contacts the jaw member 6. Whereas the old dovetail or rectangular key arrangement would concentrate the rotative forces on one edge of the die, the present invention provides for a plurality of splines which collectively have a comparatively large bearing surface against the grooves 11. The result is that die/-jaw member wear is significantly decreased. In a preferred embodiment, shown in the figures, splines 13 have tapered sides 18, allowing for an even larger bearing surface, while creating a self-adjusting feature. Because of this feature the tapered sides 18 of the grooves 11 and splines 13 are allowed to slide slightly, relative to each other, allowing the die 7 to firmly seat itself in the jaw 6, assuring a maximum bearing surface area.

The die 7 is provided with a concave wearing surface 16 which conforms to the radial curvature of the pipe 9 to be gripped. The wearing surface 16 may be milled with various patterns of teeth 17 in order to provide additional gripping strength. Thus, as different diameters of pipe 9 are encountered, one need only remove screw 14 and slide in a different die 7. The same procedure is followed to replace a worn die 7.

The use of splines 13 to retain and support the die 7 has resulted in a jaw assembly 5 which is more economical to operate and which will not damage lightweight drill pipe. The die 7 may be easily changed without replacing the jaw member 6. The area of contact between die 7 and pipe 9 has been greatly increased over prior art. This increase results in less damage to the pipe as well as decreased die wear and increased tool efficiency. The jaw assembly 5 may be adapted to be utilized with manually operated tools as well as tools which are hydraulically or otherwise operated.

Figure 5:
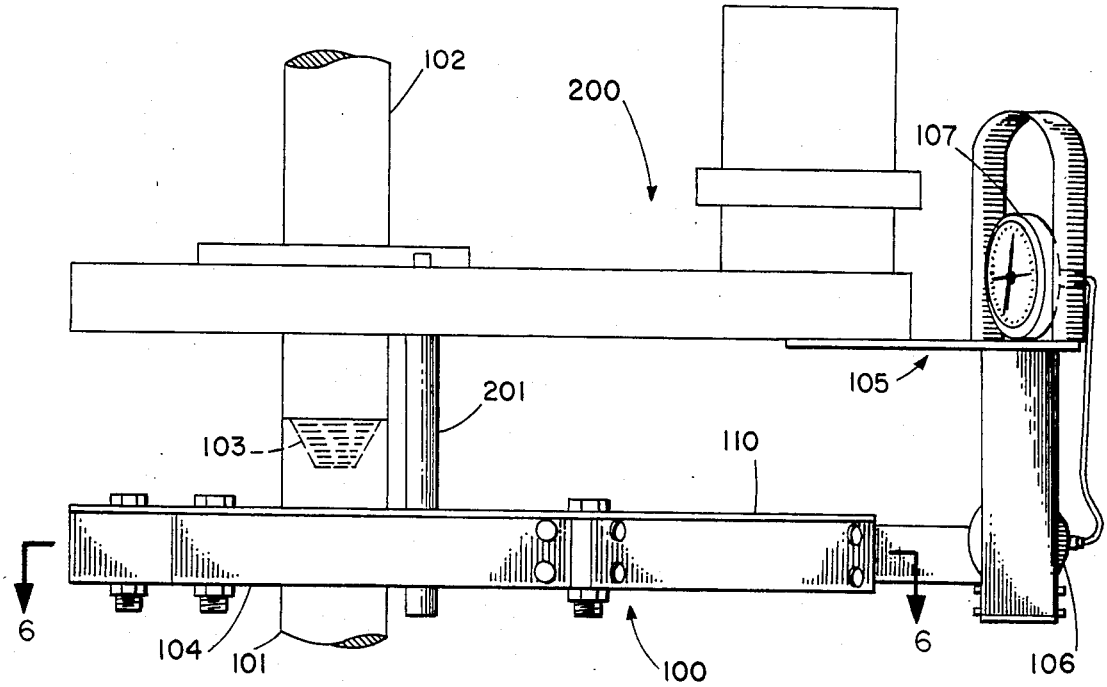
FIG. 5 is a side view of a preferred embodiment of the back-up power tongs of this invention in place in conjunction with power tongs.
Figure 6:
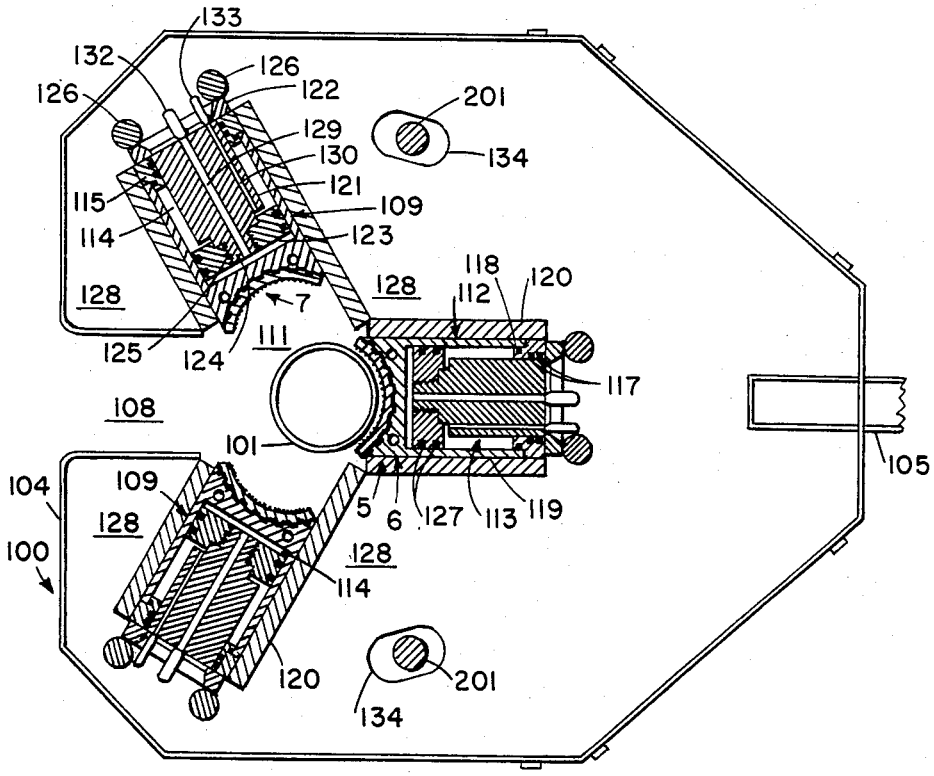
FIG. 6 is a sectional top view along line 6—6 of FIG. 5.
Figure 7:
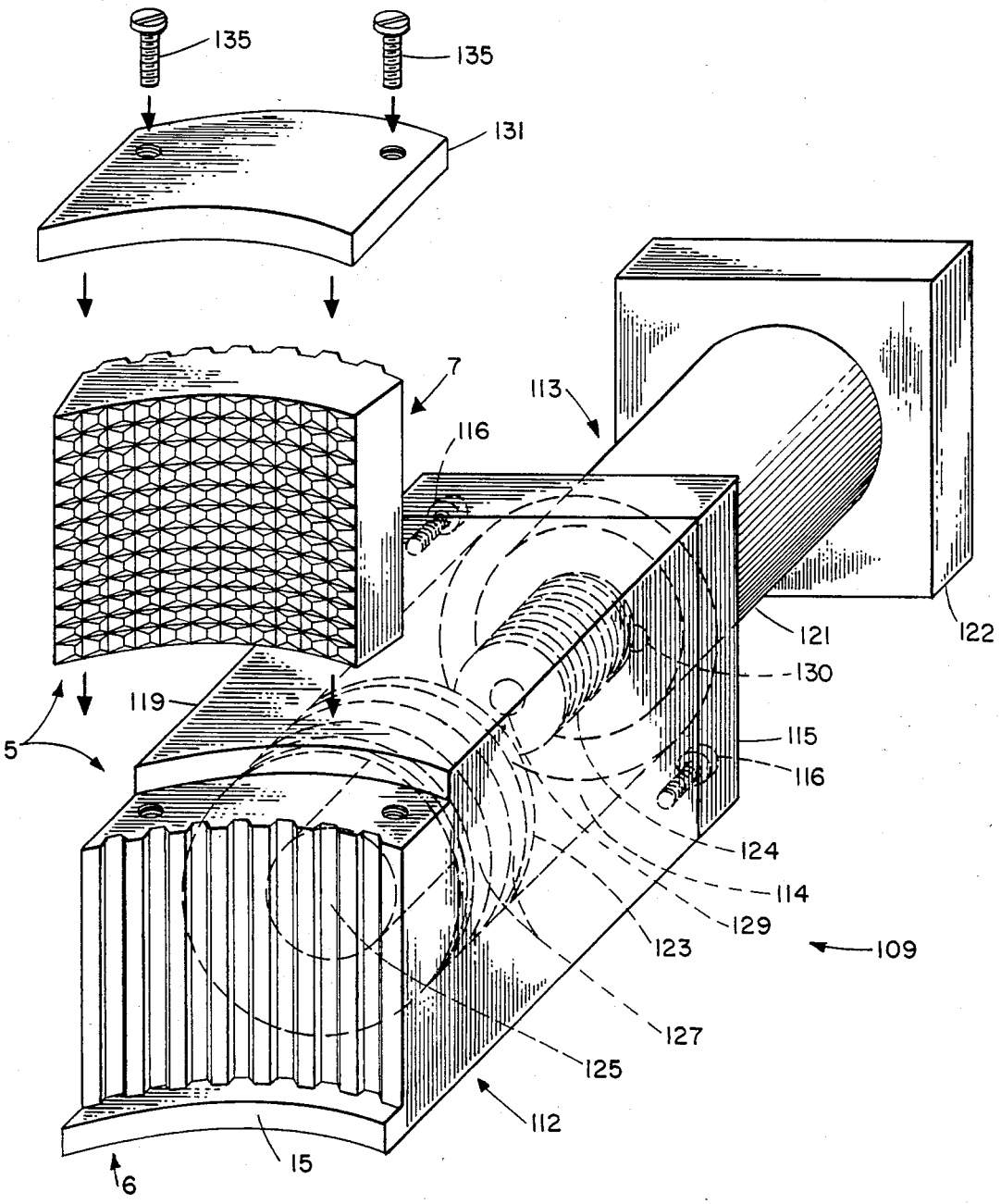
FIG. 7 is a partially exploded perspective view of a preferred embodiment of the cylinder assembly and jaw member of this invention.

As shown in FIGS. 5–7, the jaw assembly 5 of the invention may be utilized as a component of a new design for back-up power tongs 100. In FIG. 5, back-up tongs 100 are shown connected to first joint 101 of drill pipe, and to a conventional set of power tongs 200. Power tongs 200 are grippingly connected to a second joint 102 of drill pipe. In order to tighten or loosen threaded connection 103, power tongs 200 grip and rotate second joint 102 while back-up tongs 100 grip and hold first joint 101. Back-up power tongs 100 employ a simplified direct pressure hydraulic gripping action in lieu of conventional cam operated tong systems. The back-up tongs 100 generally comprise a hollow body 104, having a body cavity 128 containing at least two jaw assemblies 5 and and least one cylinder assembly 109. Access to body cavity 128 is provided by removing cover 110. Body 104 is rigidly connectible to power tongs 200 via frame assembly 105. Conventional means, such as a load cell 106 and gauge 107 may be employed to indicate torque. Legs 201 are provided on many power tongs 200 to align the power tongs 200 with back up tongs 100 and to support power tongs 200 when resting on a flat surface. Alignment holes 134 in body 104 may be provided for legs 201.

As shown in FIG. 6, it is preferable that the backup tongs 100 have three jaw assemblies 5, radially spaced around a center opening 111 so as to maximize circumferential contact with the first joint 101. Slot 108 provides access to center opening 111. As previously described, each jaw assembly 5 comprises a jaw member 6 and a die 7, with their previously described features. As shown in FIG. 7, die 7 maybe additionally secured by cover plate 131 and cover plate screws 135. Preferably, jaw assemblies 5 are each fixedly connected to a cylinder assembly 109, such that cylinder assembly 109 extends or retracts jaw assembly 5 on a radial path centered at the center of first joint 101. Cylinder assemblies 109 are driven by hydraulic pressure, thus providing a means for applying direct gripping pressure to first joint 101 without the complicated and inefficient cam assemblies of the prior art.

As shown in FIG. 7, the jaw assembly 5 and cylinder assembly 109, when assembled, form a single unit which may be easily removed from body cavity 128 for repair or replacement. Referring to FIGS. 6 and 7, cylinder assembly 109 comprises a cylinder body 112 and a stationary piston 113. Preferably, jaw member 6 is integrally formed as a single unit with cylinder body 112. Cylinder body 112 comprises a cylinder wall 119 encasing cylinder cavity 114, and a gland 115, which is held in place by gland screws 116, and matingly and slidingly engages piston 113. Gland seals 117 provide a seal between gland 115 and piston rod 121. Static seal 118 prevents leakage between cylinder wall 119 and gland 115. Each cylinder body 112 preferably has a rectangular outer dimension and is contained in body cavity 128 by cylinder guides 120, which may simply comprise flat bar stock welded into body cavity 128.

Piston 113 comprises a piston rod 121, piston backplate 122 and piston head 123. Piston rod 121 is provided with a threaded end 124 onto which piston head 123 is matingly threadable, through threaded opening 125. Piston backplate 122 is welded to piston rod 121 to provide a backstop for gland 115 and to provide thrust support for the entire cylinder assembly 109 against support pins 126 in the body cavity 128. Hydraulic control of cylinder assembly 109 is maintained using first fluid port 129 and second fluid port 130. A seal between piston head 123 and piston wall are provided by piston seals 127.

In order to extend jaw assembly 5 into contact with first joint 101, fluid from a fluid system (not shown) is pumped through first coupling 132 and first fluid port 129 into cylinder cavity 114 in front of piston head 123, forcing cylinder body 112 to slide along piston rod 121 toward first joint 101. Any fluid in cylinder cavity 114 behind piston head 123 is forced out through second fluid port 130 and second coupling 133. The extension process is reversed by pumping fluid through second fluid port 130 in order to retract jaw assembly 5.

By providing three cylinder assemblies 109 operated by a common fluid system, back-up tongs 100 provide a simplified, yet powerful back-up device. When cylinder assemblies 109 are coupled with jaw assemblies 5, variations in the diameter of first joint 101 may be accommodated by simply changing dies 7. Of course, it should be understood that conventional jaw assemblies could be utilized in conjunction with back-up power tongs 100. A further simplified version of back-up tongs 100 would comprise a stationary jaw assembly 5, positionable against first joint 101, and at least one cylinder assembly 109 and associated jaw assembly 5, positionable on the opposite side of first joint 101 from the stationary jaw assembly 5. Of course, other embodiments of the invention will occur to those skilled in the art, and are intended to be within the scope and spirit of the following claims.

I claim:

1. Back-up power tongs for holding a tubular member against rotation of a connected tubular member, comprising:

a. a body, having a center opening of sufficient size for a tubular member to pass therethrough, a slot communicating between the edge of said body and said center opening, said slot having a width greater than the diameter of said tubular member, and a cavity disposed within said body;

b. a plurality of jaw members disposed within said body around the perimeter of said center opening, each said jaw member having a concave surface generally conforming to the curvature of said tubular member and facing the interior of said center opening so as to be grippingly engageable with said tubular menber;

c. at least one cylinder assembly, disposed within said cavity and fixedly connected to one said jaw member so as to extend or retract said jaw member on a radial path centered at the center of said tubular member, said cylinder assembly including:

i. a cylinder body, fixedly connected to said jaw member at one end and having a cylinder cavity opening from the interior of said cylinder body to the other end of said cylinder body;

ii. a piston, having first and second ends, positionable within said cylinder cavity, and having a piston head at said first end slidingly and sealingly positionable within said cylinder cavity, and a piston rod extending between said piston head and said second end, said second end being fixedly positionable within said body cavity, and sealingly attachable to said other end of said cylinder body so as to slidingly seal said cylinder cavity from the exterior of said cylinder body, said piston further having a first fluid port communicating between said first and second ends, and a second fluid port communicating between said second end and the exterior of said piston rod behind said piston head, said first and second ports being connectable at said second end to a fluid system.

2. Back-up power tongs according to claim 1, wherein a plurality of said cylinder assemblies are provided within said body cavity.

3. Back-up power tongs according to claim 1, wherein three said cylinder assemblies are provided within said body cavity.

4. Back-up power tongs according to claim 1, wherein said concave surface of each said jaw member is provided with a plurality of parallel cog-shaped splines radially spaced over said concave surface, forming parallel cog-shaped grooves between said splines, each said spline extending outward substantially perpendicular from said concave surface.

5. Back-up power tongs according to claim 4, wherein said jaw member further comprises a die, attachable to said jaw member, and having a convex surface matingly conforming to the curvature of said concave surface of said jaw member, which said convex surface is provided with a plurality of parallel cog-shaped splines, forming parallel cog-shaped grooves between said splines, each said spline extending outward substantially perpendicular from said convex surface, said splines being alignable with and matingly and slidably insertable within said grooves of said jaw member, said splines of said jaw member being alignable with and matingly and slidably insertable within said grooves of said die, and said die having a concave surface conforming to the radial curvature of said tubular member.

6. Back-up power tongs according to claim 2, wherein said concave surface of each said jaw member is provided with a plurality of parallel cog-shaped splines radially spaced over said concave surface, forming parallel cog-shaped grooves between said splines, each said spline extending outward substantially perpendicular from said concave surface.

7. Back-up power tongs according to claim 6, wherein said jaw member further comprises a die, attachable to said jaw member, and having a convex surface matingly conforming to the curvature of said concave surface of said jaw member, which said convex surface is provided with a plurality of parallel cog-shaped splines, forming parallel cog-shaped grooves between said splines, each said spline extending outward substantially perpendicular from said convex surface, said splines being alignable with and matingly and slidably insertable within said grooves of said jaw member, said splines of said jaw member being alignable with and matingly and slidably insertable within said grooves of said die, and said die having a concave surface conforming to the radial curvature of said tubular member.

8. Back-up power tongs according to claim 3, wherein said concave surface of each of said jaw member is provided with a plurality of parallel cog-shaped splines radially spaced over said concave surface, forming parallel cog-shaped grooves between said splines, each said spline extending outward substantially perpendicular from said concave surface.

9. Back-up power tongs according to claim 8, wherein said jaw member further comprises a die, attachable to said jaw member, and having a convex surface matingly conforming to the curvature of said concave surface of said jaw member, which said convex surface is provided with a plurality of parallel cog-shaped splines, forming parallel cog-shaped grooves between said splines, each spline extending outward substantially perpendicular from said convex surface, said splines being alignable with and matingly and slidably insertable within said grooves of said jaw member, said splines of said jaw member being alignable with and matingly and slidably insertable within said grooves of said die, and said die having a concave surface conforming to the radial curvature of said tubular member.

10. Back-up power tongs according to claim 4, wherein said concave surface of each said jaw member is provided with a plurality of parallel cog-shaped splines radially spaced over said concave surface, forming parallel cog-shaped grooves between said splines, each said spline extending outward substantially perpendicular from said concave surface.

11. Back-up power tongs according to claim 10, wherein said jaw member further comprises a die, attachable to said jaw member, and having a convex surface matingly conforming to the curvature of said concave surface of said jaw member, which said convex surface is provided with a plurality of parallel cog-shaped splines, forming parallel cog-shaped grooves between said splines, each said spline extending outward substantially perpendicular from said convex surface, said splines being alignable with and matingly and slidably insertable within said grooves of said jaw member, said splines of said jaw member being alignable with and matingly and slidably insertable within said grooves of said die, and said die having a concave surface conforming to the radial curvature of said tubular member.

* * * * *